US007926157B2

(12) United States Patent
Seewraj et al.

(10) Patent No.: US 7,926,157 B2
(45) Date of Patent: Apr. 19, 2011

(54) HYDRAULIC DAMPER VALVE

(75) Inventors: Angraj Kumar Seewraj, Welwyn (GB); Terence Gilbert, Welwyn Garden (GB)

(73) Assignee: Avdel UK Limited, Hertfordshire (GB)

( * ) Notice: Subject to any disclaimer, the term of this patent is extended or adjusted under 35 U.S.C. 154(b) by 359 days.

(21) Appl. No.: 12/160,047

(22) PCT Filed: Mar. 19, 2007

(86) PCT No.: PCT/GB2007/001000

§ 371 (c)(1),
(2), (4) Date: Aug. 14, 2008

(87) PCT Pub. No.: WO2007/107751

PCT Pub. Date: Sep. 27, 2007

(65) Prior Publication Data

US 2008/0302168 A1 Dec. 11, 2008

(30) Foreign Application Priority Data

Mar. 22, 2006 (GB) ..... 0605910.9

(51) Int. Cl.
*B21J 15/20* (2006.01)
*B21J 15/34* (2006.01)

(52) U.S. Cl. ..... 29/243.525; 29/243.523; 72/391.4

(58) Field of Classification Search ..... 72/391.4, 72/391.6; 29/243.523, 243.524, 243.525, 29/243.528, 243.529

See application file for complete search history.

(56) References Cited

U.S. PATENT DOCUMENTS

| | | | | |
|---|---|---|---|---|
| 3,254,522 | A * | 6/1966 | Elliott et al. | 29/243.525 |
| 4,380,923 | A | 4/1983 | Emmerich | |
| 4,515,005 | A * | 5/1985 | Klein | 29/243.525 |
| 4,580,435 | A * | 4/1986 | Port et al. | 29/243.525 |
| 4,598,571 | A * | 7/1986 | Oefinger | 29/243.525 |
| 5,742,989 | A * | 4/1998 | Subotsch | 29/243.525 |
| 6,367,139 | B2 * | 4/2002 | Wille | 29/243.525 |

FOREIGN PATENT DOCUMENTS

| | | | |
|---|---|---|---|
| DE | 31 53 057 | C2 | 5/1985 |
| EP | 1 132 160 | A1 | 9/2001 |
| JP | 10249238 | A | 10/1989 |
| SU | 1546201 | A1 | 2/1990 |
| WO | 98/48958 | A1 | 11/1998 |
| WO | 2005/025772 | A1 | 3/2005 |

OTHER PUBLICATIONS

European Combined Search and Examination Report dated May 23, 2006 which issued in connection with corresponding British Application No. GB0605910.9.

PCT International Search Report dated Jun. 5, 2007 which issued in connection with corresponding International Application No. PCT/GB2007/001000.

* cited by examiner

*Primary Examiner* — David B Jones

(74) *Attorney, Agent, or Firm* — Hahn, Loeser & Parks LLP; Arland T. Stein

(57) ABSTRACT

A breakstem rivet placing tool conventionally includes a flow restrictions for hydraulic fluid used to drive the tool in a stem pulling direction. This serves to prevent recoil of the tool due to rapid acceleration of an internal piston when the stem of the breakstem rivet breaks. Prior art flow restrictions create a jet of high velocity hydraulic fluid into the tool which may damage components by erosion. A revised fluid damper valve deflects and/or diffuses the fluid flow to avoid damage by erosion.

11 Claims, 4 Drawing Sheets

HYDRAULIC DAMPER VALVE

RELATED/PRIORITY APPLICATION

This application is a National Phase filing regarding International Application No. PCT/GB2007/001000, filed on Mar. 19, 2007. International Application No. PCT/GB2007/001000 relies upon British Application No. 0605910.9, filed on Mar. 12, 2006 for priority.

This invention relates to an improved hydraulic damper valve and in particular to such a valve for use with a hydro-pneumatically operated riveting tool for breakstem fasteners.

FIG. 1 shows a rivet placing tool known in the prior art. The tool has gripping means (not shown) which co-operate with a hydraulic piston arrangement 4 to grip and pull the stem of a breakstem fastener in the manner known in the art. The gripping means pull the stem in the direction shown by arrow 'A' when hydraulic fluid enters an inlet port 6 of the cylinder 8 associated with the piston 4.

As is known in the art, the pulling of the stem of the rivet eventually results in breaking of the stem to leave the placed rivet behind. At the moment of breakage of the stem, the pulling load required on the gripping means rapidly diminishes. In order to avoid rapid acceleration of the piston 4 rearwardly, conventionally a flow restriction is placed in the hydraulic fluid path into the tool in order to produce a decrease in hydraulic pressure in the cylinder 8 as the piston 4 attempts to accelerate. Thus the flow restriction has the effect of damping the rearward movement of the piston 4 which makes for more comfortable operation and better tool life.

FIGS. 2A and 2B show an enlargement of the area around the inlet port 6. The thick dotted line 10 shows the general direction of hydraulic flow into the tool during the pulling operation.

Following pulling, the piston and gripping means returns to a forward rest position ready for further rivet replacement, under spring and/or pneumatic action as is know in the art. As this happens, hydraulic fluid flows out of the port 6 in a direction opposite to that indicated by arrow 10. Thus in use, hydraulic fluid flows in both directions through the port 6 as indicated by arrow 12 on FIG. 1.

Conventionally, therefore, a moveable member 14 is held close to the inlet port 6 by shoulders 16 (which restrict outward movement of the member away from the tool during outward flow of hydraulic fluid) and a sealing region 18 around the periphery of the inlet port 6.

In FIG. 2A, the movable member 14 is shown in a non-sealing position in which an inner surface 20 of the moveable member 14 is held away from the sealing region 18, against the shoulders 16, by flow of hydraulic fluid. In this position, fluid is free to flow around the periphery of the moveable member 14 by virtue of cut outs 22. Thus as the gripping means and piston 4 return to the rest position, the flow of hydraulic fluid out of the port 6 is largely unrestricted. However, when fluid flows in the opposite direction (that shown by arrow 10), the moveable member 14 is pushed so that its inner surface 20 rests against the sealing surface 18 around the periphery of the inlet port 6. This has the effect of preventing fluid flow around the periphery of the moveable member 14 so that fluid may only flow through a central aperture 24. The aperture 24 is arranged to have a greatly reduced cross-sectional flow area relative to the cut out portions 18. Thus during pulling of the stem or rivet, fluid may only flow through the restricted aperture 24 into the tool. This flow restriction provides the damping effect described above.

However, the flow restriction also increases the velocity of flow and thus creates a jet of fluid into the inlet port 6 of the tool. In the example shown in FIG. 2A, this jet (denoted by arrow 10) impinges directly on an elastomer seal 26. This is undesirable since the high velocity of the jet may reduce the operating lifetime of the seal 26 by erosion effects.

Accordingly, it is an object of the present invention to provide a damping effect during pulling of the stem of a breakstem rivet whilst avoiding damage to vulnerable internal parts of the placing tool.

In a first aspect, the invention provides a hydro-pneumatically operated riveting tool, which tool includes hydraulically driven gripping means for gripping and pulling the stem of a rivet, thereby to place the rivet, a hydraulic inlet port for supplying hydraulic fluid to drive the gripping means, a sealing region around the inlet port, and return means for returning the gripping means back to a rest position again after placing a rivet, the hydraulic supply for the gripping means including a unidirectional flow restriction arranged to provide a restricted flow of hydraulic fluid during pulling of the stem and to provide relatively free flow during return of the gripping means to a rest position, the flow restriction comprising a moveable member located in the hydraulic flow path adjacent the inlet port which is arranged to have limited reciprocal movement in the direction of hydraulic flow towards and away from the inlet port into a sealing and non-sealing position, the moveable member having an inner surface which cooperates with the sealing region around the inlet port to form a seal which substantially prevents flow of hydraulic oil around the periphery of the moveable member when the member is pushed by hydraulic flow into the sealing position, the moveable member including an aperture of relatively small cross-sectional flow area through which hydraulic fluid is permitted to flow when the moveable member is in the sealing position, the moveable member being arranged to diffuse or direct hydraulic flow through the aperture away from components susceptible to erosion which are in the vicinity of the inlet port.

In a further aspect, the invention provides a moveable member for use in the tool of the first aspect.

Embodiments of the invention will now be described by way of example and with reference to the drawings in which:—

Figure 1:
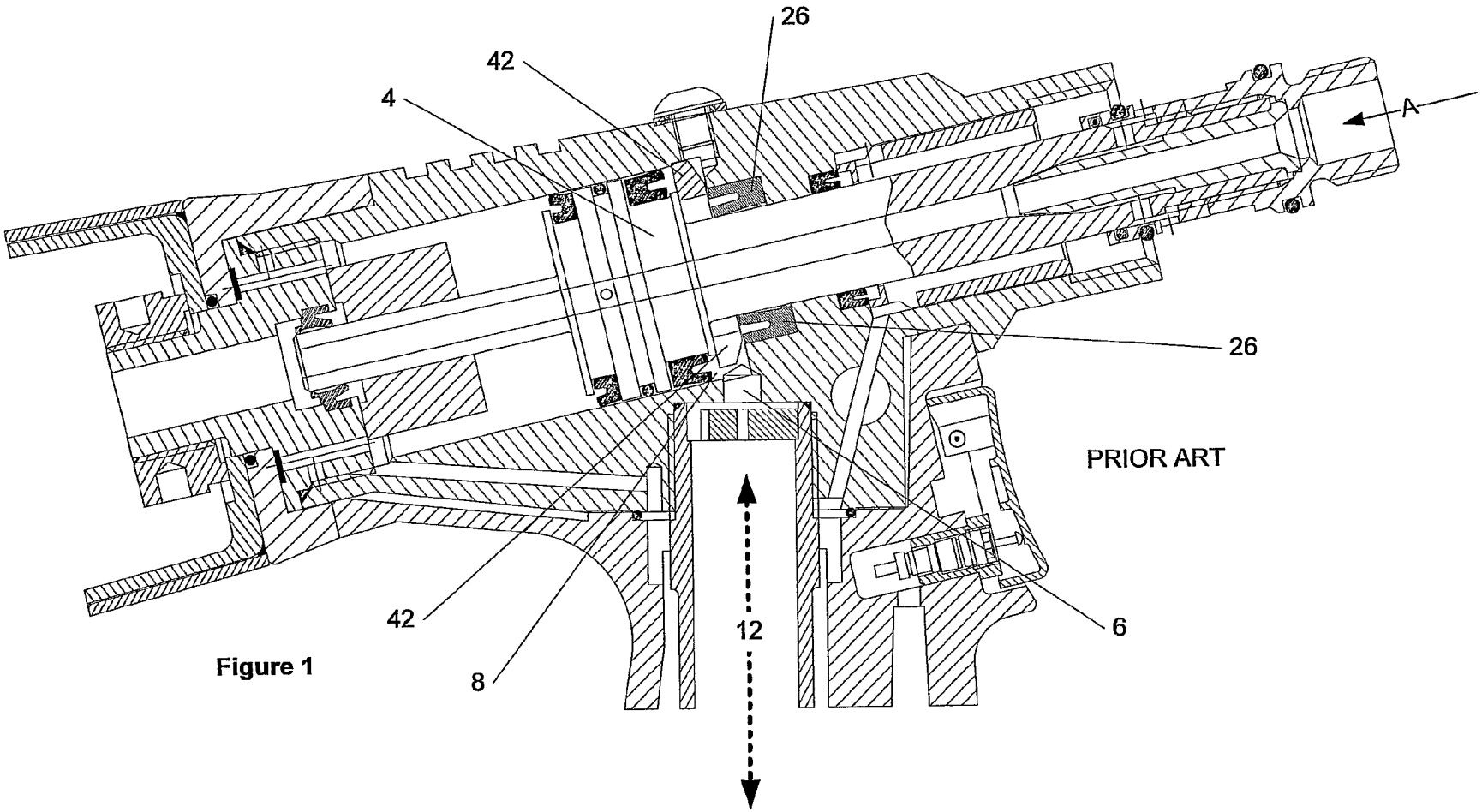
FIG. 1 is a section through a rivet placing tool as known in the prior art.
Figure 2A:
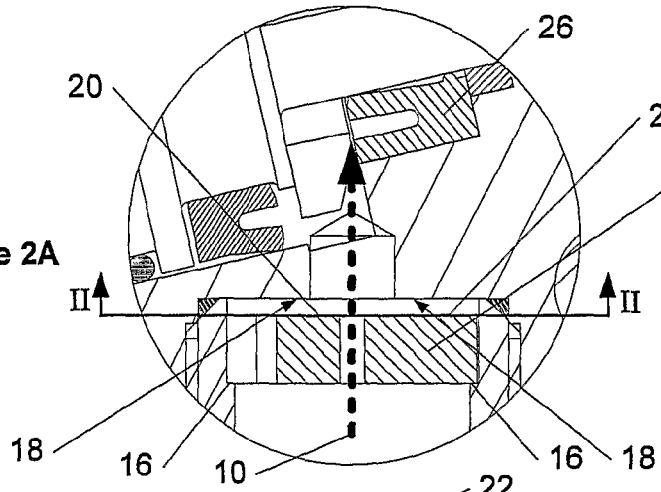
Figure 2A PRIOR ART
FIG. 2A is an enlargement of FIG. 1 in the region of a hydraulic inlet port.
Figure 2B:
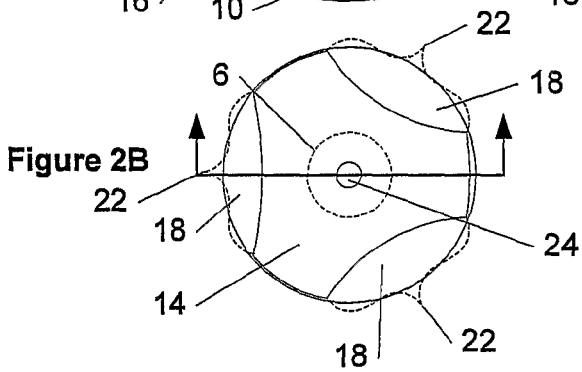
Figure 2B PRIOR ART
FIG. 2B is a section through FIG. 2A along line II-II.
Figure 3A:
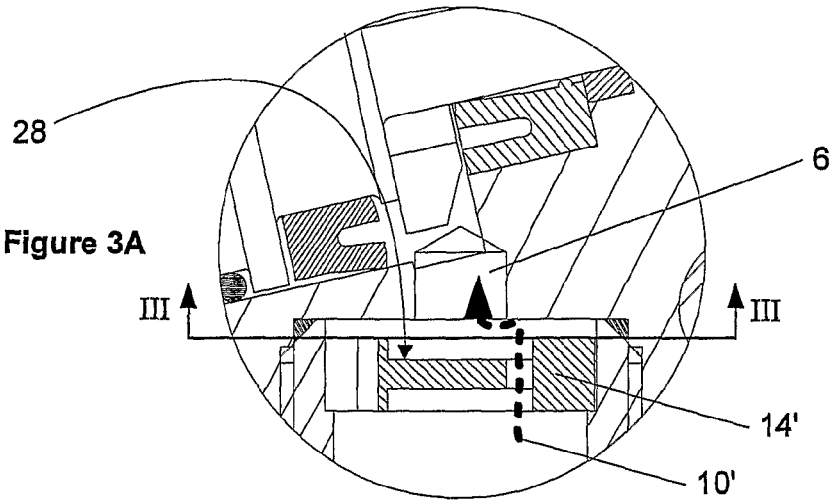
FIG. 3A is a view corresponding to that of FIG. 2A showing a new moveable member in accordance with the invention.
Figure 3B:
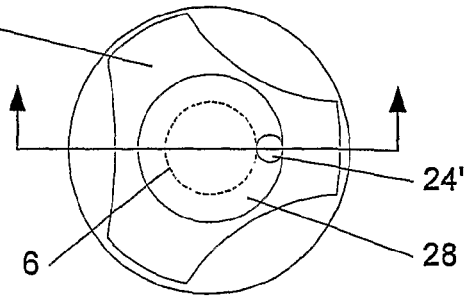
FIG. 3B is a sectional view along line III-III of FIG. 3A.

With reference to FIGS. 3A and 3B, in a first embodiment, a moveable member 14' has a port 24', offset from the centre of the member 14'. The moveable member 14' is shown in a non-sealing position.

A counter bore 28 is formed to allow fluid to flow in a direction generally indicated by arrow 10. It will be noted that the fluid flow during stem pulling now follows a convoluted path since the aperture 24' is deliberately misaligned with the port 6. This has the effect of reducing the velocity of the flow as it enters the port 6. The material forming the periphery of the inlet port 6 typically is hard anodised aluminium. Thus at the point 30 on which it is impinged by the jet 10, it is able to resist erosion. Furthermore, any erosion occurring at this point is not detrimental to operation of the tool.

Preferably, the counter bore 28 is formed on both sides of the member 14' so that the member may be assembled in either orientation. Furthermore, it will be appreciated that the moveable member is free to rotate but the selection of the position of the port 24' is such that even after rotation it will always direct fluid flow around the periphery port 6 rather than directly into the port.

Accordingly, the embodiment shown in FIGS. 3A and 3B is a convenient retrofit to the prior art tool and solves the problem of erosion of delicate components within the tool and within the port 6.

Figure 4A:
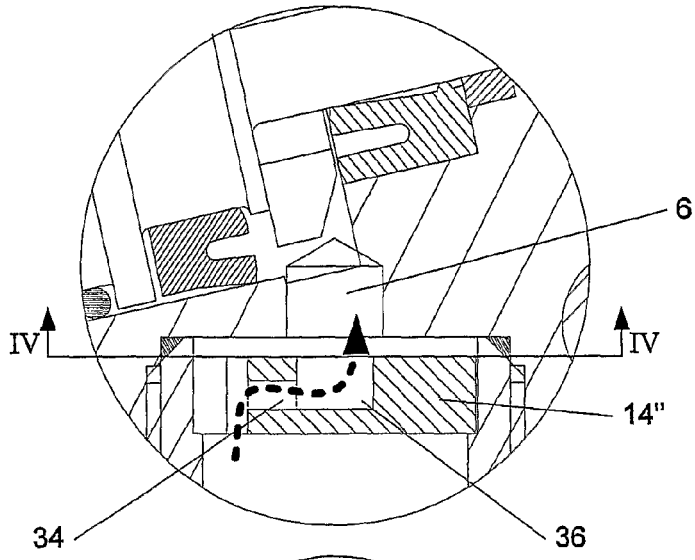
FIG. 4A is a view corresponding to that of FIG. 3A showing a new moveable member in accordance with the invention.
Figure 4B:
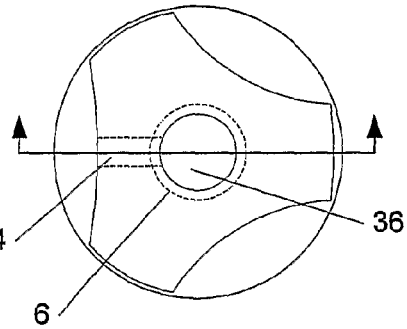
FIG. 4B is a sectional view along line IV-IV of FIG. 4A.

With reference to FIGS. 4A and 4B, a further alternative moveable member 14" is shown. Again, the member 14" is shown in a non-sealing position.

In this embodiment, a side port 34 forms an inlet into the moveable member 14" which then feeds into an enlarged generally central outlet port 36. The outlet port is in registry with the inlet port of the tool 6 but has a greater cross-sectional area than the side port 34. Thus as fluid transitions from the side port 34 to the outlet port 36, the increase in flow cross-sectional area results in a reduction in fluid velocity. Accordingly, erosion of delicate components within the inlet port 6 is avoided through a reduction in velocity of the fluid flow while still maintaining the flow restriction necessary for damping operation of the tool during stem pulling.

Figure 5A:
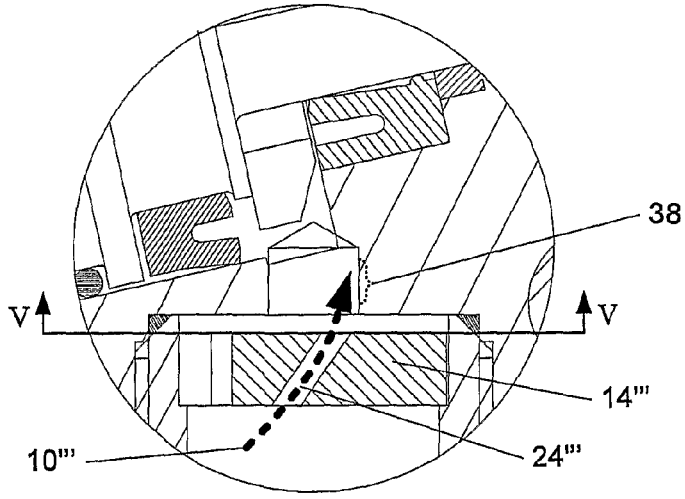
FIG. 5A is a view corresponding to that of FIG. 4A showing a new moveable member in accordance with the invention.
Figure 5B:
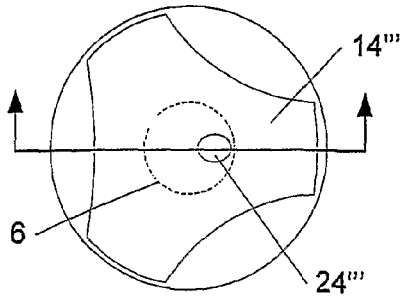
FIG. 5B is a sectional view along line V-V of FIG. 5A.

With reference to FIGS. 5A and 5B, a further alternative moveable member 14''' is shown. In this embodiment, an aperture 24''' is formed through a moveable member 14''' at an angle to the direction of fluid flow into the inlet port 6. This causes the fluid flow 10''' to be directed against a hard side wall region 38 of the inlet port 6. The region 38 is not critical and is generally resistant to erosion. Having impacted the region 38, the fluid is dispersed and the velocity reduced as it passes upwardly into the more delicate parts of the tool. Accordingly, any problems with erosion are avoided.

Furthermore, the angled port 24''' is preferably angled symmetrically about a centre line of the moveable member 14''' so that it may be installed in either orientation during tool assembly. It will be noted by comparison with FIGS. 3A and 3B that this embodiment does not require a counter bore 28 since the outlet from the moveable member on its inner surface adjacent the inlet port 6 is in registry with the inlet port 6. This embodiment also is a convenient retrofit to existing tools.

Figure 6A:
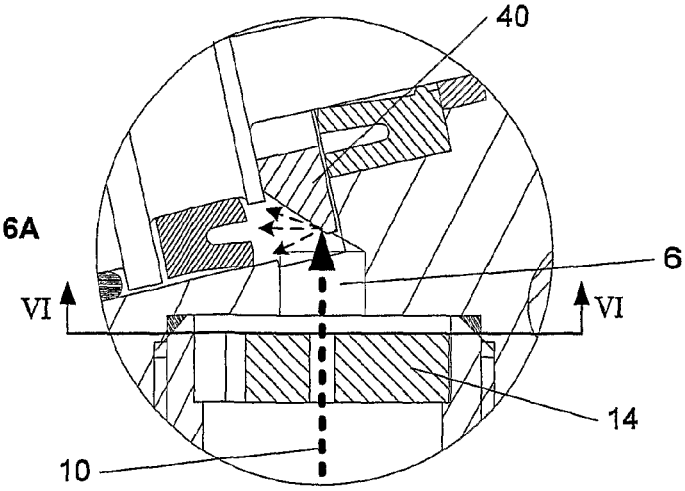
FIG. 6A shows a view similar to FIG. 2A but including a diffuser component in accordance with the present invention.
Figure 6B:
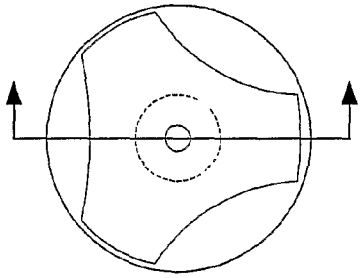
FIG. 6B is a section along line VI-VI of FIG. 6A.
Figure 7A:
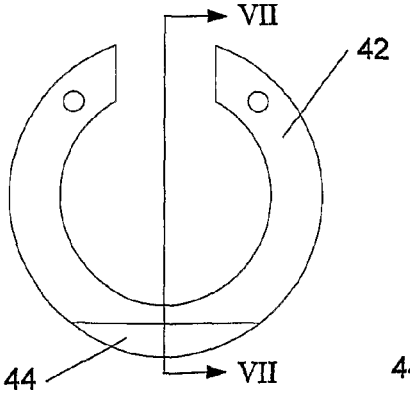
FIG. 7A is an elevation of a seal clip in accordance with the invention.
Figure 7B:
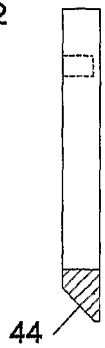
FIG. 7B is a section along line VII-VII of FIG. 7A.

With reference to FIGS. 6A and 6B, a diffuser or deflector 40 may be inserted into the inlet port 6 in order to reduce fluid velocity in a similar manner to the embodiment shown in FIGS. 5A and 5B. This may be used with the prior art moveable member 14. Advantageously, the deflector may be formed as a revised (chamfered) portion of a circlip 42 already present in the tool (see FIG. 7A). This clip or other similar other component is presently used to hold the seal 26 in place. By providing a chamfer 44, the fluid flow 10 is deflected and reflected at reduced speed into the tool 6 thereby avoiding any problems with erosion.

Figure 8A:
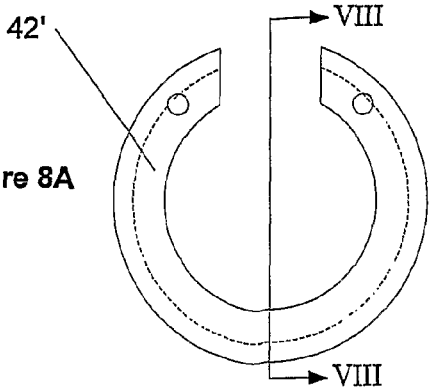
FIG. 8A is an elevation of an alternative seal clip.
Figure 8B:
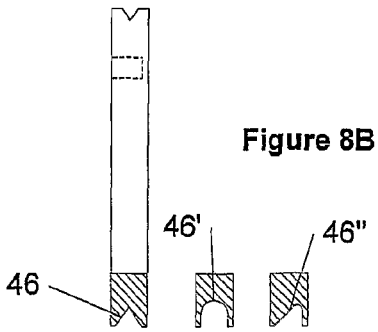
FIG. 8B shows several alternative sectional configurations along the lines VIII-VIII of FIG. 8A.

FIGS. 8A and 8B show alternative configurations in which recesses 46, 46' and 46" serve to capture the fluid flow 10 and reflect it back at reduced velocity. Again, these components are a simple retrofit to existing tools.

Thus the components described above may conveniently be retrofitted to existing tools and serve to deflect or redirect high velocity fluid flow created by a flow restriction used for damping during stem pulling. The deflection, diffusion or redirection serves to avoid the erosion of vulnerable parts in the vicinity of the inlet port.

The invention claimed is:

1. A hydro-pneumatically operated riveting tool for installing a rivet, including hydraulically driven gripping means for gripping and pulling a stem of the rivet, thereby to place the rivet, a hydraulic supply comprising a hydraulic inlet port for supplying hydraulic fluid to drive the gripping means, a sealing region around the inlet port, and return means for returning the gripping means back to a rest position again after placing a rivet;

the hydraulic supply for the gripping means including a unidirectional flow restriction arranged to provide a restricted flow of hydraulic fluid during pulling of the stem and to provide relatively free flow during return of the gripping means to the rest position, the unidirectional flow restriction comprising a moveable member located in a path of the hydraulic flow adjacent the inlet port which is arranged to have limited reciprocal movement in a direction of hydraulic flow towards and away from the inlet port into a sealing and non-sealing position, the moveable member having an inner surface which cooperates with the sealing region around the inlet port to form a seal which substantially prevents flow of hydraulic fluid around a periphery of the moveable member when the member is pushed by hydraulic flow into the sealing position, the moveable member including a member inlet and a member outlet, and an aperture of relatively small cross-sectional flow area through which hydraulic fluid is permitted to flow when the moveable member is in the sealing position, the moveable member being arranged to diffuse or direct hydraulic flow through the aperture away from components which are in the vicinity of the inlet port;

wherein the member outlet has a smaller cross-sectional area than the member inlet so that as fluid transitions from the member inlet to the member outlet, the velocity of the hydraulic fluid is reduced.

2. A tool according to claim 1, wherein the member inlet is on a side of the moveable member, wherein the side is perpendicular to the inner surface, and the member outlet is on the inner surface, the member inlet and member outlet being joined by an internal passage having a convoluted path within the member.

3. A moveable member for use in the tool of claim 2, comprising a disc having a first major face arranged to seal against the sealing region of the inlet port of a rivet placing tool, and an member inlet on a side of the disc in fluid communication with a member outlet on the first major face of the disc, wherein the side of the disc is perpendicular to the first major face.

4. A moveable member for use in the tool of claim 1, wherein the member inlet has a smaller cross-sectional flow area than the member outlet.

5. A hydro-pneumatically operated riveting tool for installing a rivet, including hydraulically driven gripping means for gripping and pulling a stem of the rivet, thereby to place the rivet, a hydraulic supply comprising a hydraulic inlet port for supplying hydraulic fluid to drive the gripping means, a sealing region around the inlet port, and return means for returning the gripping means back to a rest position again after placing a rivet;

the hydraulic supply for the gripping means including a unidirectional flow restriction arranged to provide a restricted flow of hydraulic fluid during pulling of the stem and to provide relatively free flow during return of the gripping means to the rest position, the unidirectional flow restriction comprising a moveable member located in a path of the hydraulic flow adjacent the inlet port which is arranged to have limited reciprocal movement in a direction of hydraulic flow towards and away from the inlet port into a sealing and non-sealing position, the moveable member having an inner surface which cooperates with the sealing region around the inlet port to form a seal which substantially prevents flow of hydraulic fluid around a periphery of the moveable member when the member is pushed by hydraulic flow into the sealing position the moveable member including an aperture of relatively small cross-sectional flow area through which hydraulic fluid is permitted to flow when the moveable member is in the sealing position, the moveable member being arranged to diffuse or direct hydraulic flow through the aperture away from components which are in the vicinity of the inlet port;

wherein the moveable member further includes a counterbore, to prevent sealing of the inner surface against the sealing surface in the region of the aperture and to provide a convoluted path for hydraulic flow through the aperture and past the counterbore when the member is in the sealing position, and wherein the aperture is misaligned with inlet port so as to reduce the velocity of hydraulic fluid as it enters the inlet port.

6. A moveable member for use in the tool of claim 5, comprising a disc having a major face arranged to seal against a sealing region of an inlet port of a rivet placing tool and an aperture passing between both major faces of the disc which is offset from the centre of the disc.

7. A hydro-pneumatically operated riveting tool for installing a rivet, including hydraulically driven gripping means for gripping and pulling the stem of a rivet, thereby to place the rivet, a hydraulic supply comprising a hydraulic inlet port for supplying hydraulic fluid to drive the gripping means, a sealing region around the inlet port, and return means for returning the gripping means back to a rest position again after placing a rivet;

the hydraulic supply for the gripping means including a unidirectional flow restriction arranged to provide a restricted flow of hydraulic fluid during pulling of the stem and to provide relatively free flow during return of the gripping means to a rest position, the unidirectional flow restriction comprising a moveable member located in the hydraulic flow path adjacent the inlet port which is arranged to have limited reciprocal movement in the direction of hydraulic flow towards and away from the inlet port into a sealing and non-sealing position, the moveable member having an inner surface which cooperates with the sealing region around the inlet port to form a seal which substantially prevents flow of hydraulic oil around the periphery of the moveable member when the moveable member is pushed by hydraulic flow into the sealing position, the moveable member including an aperture of relatively small cross-sectional flow area, wherein hydraulic fluid is permitted to flow through the aperture when the moveable member is in the sealing position;

wherein the member is arranged to direct the hydraulic flow through the aperture to a diffuser component located in the inlet port near the moveable member.

8. A tool according to claim 7, wherein the diffuser component includes a deflection surface which is non-parallel and non-orthogonal with side walls of the inlet port and which deflects flow received through the aperture away from components which are in the vicinity of the inlet port.

9. A tool according to claim 7, wherein the diffuser component includes a recessed portion arranged to capture and reflect the flow through the aperture thereby reducing the velocity of the flow.

10. A hydro-pneumatically operated riveting tool for installing a rivet, including hydraulically driven gripping means for gripping and pulling the stem of a rivet, thereby to place the rivet, a hydraulic supply comprising a hydraulic inlet port for supplying hydraulic fluid to drive the gripping means, a sealing region around the inlet port, and return means for returning the gripping means back to a rest position again after placing a rivet;

the hydraulic supply for the gripping means including a unidirectional flow restriction arranged to provide a restricted flow of hydraulic fluid during pulling of the stem and to provide relatively free flow during return of the gripping means to a rest position, the unidirectional flow restriction comprising a moveable member located in the hydraulic flow path adjacent the inlet port which is arranged to have limited reciprocal movement in the direction of hydraulic flow towards and away from the inlet port into a sealing and non-sealing position, the moveable member having an inner surface which cooperates with the sealing region around the inlet port to form a seal which substantially prevents flow of hydraulic oil around the periphery of the moveable member when the moveable member is pushed by hydraulic flow into the sealing position, the moveable member including an aperture of relatively small cross-sectional flow area, wherein hydraulic fluid is permitted to flow through the aperture when the moveable member is in the sealing position, the moveable member being arranged so as to diffuse or direct hydraulic flow through the aperture away from components susceptible to erosion which are in the vicinity of the inlet port;

characterized in that the aperture is formed as a generally linear passage at an angle to the direction of hydraulic flow such that the restricted flow through the aperture towards the inlet port is directed at a side wall of the inlet port.

11. A moveable member for use in the tool of claim 10, comprising a disc having a major face arranged to seal against a sealing region of an inlet port of a rivet placing tool and a flow-restriction aperture passing between both major faces of the disc, the aperture passing through the disc in a direction non-parallel with the axis of the disc.

* * * * *